US010044134B2

(12) United States Patent
Nicholson

(10) Patent No.: US 10,044,134 B2
(45) Date of Patent: Aug. 7, 2018

(54) WET MATE CONNECTOR

(71) Applicant: OneSubsea IP UK Limited, London (GB)

(72) Inventor: Allan Nicholson, Broughton-inFurness (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/032,231

(22) PCT Filed: Nov. 7, 2014

(86) PCT No.: PCT/IB2014/003091
§ 371 (c)(1),
(2) Date: Apr. 26, 2016

(87) PCT Pub. No.: WO2015/068050
PCT Pub. Date: May 14, 2015

(65) Prior Publication Data

US 2016/0276775 A1 Sep. 22, 2016

Related U.S. Application Data

(60) Provisional application No. 61/902,030, filed on Nov. 8, 2013.

(51) Int. Cl.
*H01R 13/523* (2006.01)
*H01R 13/17* (2006.01)
*H01R 13/52* (2006.01)

(52) U.S. Cl.
CPC ..... *H01R 13/523* (2013.01); *H01R 13/17* (2013.01); *H01R 13/5219* (2013.01)

(58) Field of Classification Search
CPC ..... H01R 13/523
USPC ..... 439/190, 191
See application file for complete search history.

(56) References Cited

U.S. PATENT DOCUMENTS

| | | | | |
|---|---|---|---|---|
| 4,142,770 | A | 3/1979 | Butler et al. | |
| 4,682,848 | A | 7/1987 | Cairns et al. | |
| 4,756,595 | A | 7/1988 | Braun et al. | |
| 7,112,080 | B2 * | 9/2006 | Nicholson | E21B 17/023 439/283 |
| 8,545,244 | B2 * | 10/2013 | Nicholson | H02G 15/14 439/204 |

(Continued)

FOREIGN PATENT DOCUMENTS

| | | |
|---|---|---|
| EP | 0124987 A2 | 11/1984 |
| EP | 1251598 A1 | 11/2002 |

OTHER PUBLICATIONS

International Search Report dated Apr. 21, 2015, issued in corresponding PCT application PCT/2014/IB2014/003091, 3 pgs.

*Primary Examiner* — Tulsidas C Patel
*Assistant Examiner* — Marcus Harcum
(74) *Attorney, Agent, or Firm* — Chamberlain Hrdlicka

(57) ABSTRACT

A contact module for a component of an electrical connector includes a housing with a bore formed within the housing and a shuttle pin slidably received within the bore of the housing. The contact module may further include a biasing mechanism to bias the shuttle pin towards a mating end of the housing, an electrical contact positioned adjacent the bore of the housing, and a diaphragm positioned within the housing with a fluid channel formed between one side of the diaphragm and the electrical contact.

20 Claims, 10 Drawing Sheets

(56) References Cited

U.S. PATENT DOCUMENTS

| | | | | |
|---|---|---|---|---|
| 9,270,051 | B1 * | 2/2016 | Christiansen | H01R 13/523 |
| 2002/0003931 | A1 | 1/2002 | Cairns et al. | |
| 2003/0147596 | A1 * | 8/2003 | Lancelle | G02B 6/3816 385/73 |
| 2006/0128196 | A1 * | 6/2006 | McKinnon | G02B 6/3816 439/201 |
| 2009/0080836 | A1 * | 3/2009 | Cairns | G02B 6/3816 385/56 |
| 2011/0129187 | A1 * | 6/2011 | Toth | G02B 6/3816 385/70 |

* cited by examiner

WET MATE CONNECTOR

BACKGROUND

This section is intended to introduce the reader to various aspects of art that may be related to one or more embodiments of the present disclosure. This discussion is believed to be helpful in providing the reader with background information to facilitate a better understanding of the present disclosure. Accordingly, it should be understood that these statements are to be read in this light, and not as admissions of prior art.

So called wet-mate or wet-mateable connectors are used in underwater applications to make a connection, such as an electrical or optical connection, in an environment that may be hostile to the electrical or optical transmission, for example in sea water, and may require special protection for the components that complete the connection. One example of an application may be an electrical or optical connection that must be made in a harsh underwater environment, such as within or through a wellhead in a subsea oil well.

After assembly of the wellhead on the seabed, control cables may be connected to sensors and other electrical equipment associated with the wellhead. A connector may include two connectable parts, such as a receptacle component (e.g., female component) and a plug component (e.g., male component), with the plug component insertable into or mateable with the receptacle component. Each component may include an electrical contact to establish an electrical connection therebetween, in which the electrical contacts are typically provided with a protective apparatus for shielding from the surrounding sea water, thereby preserving the integrity of the connector and the electrical connection when subsequently made.

The receptacle component may house a male connecting/contact pin, and the plug component may house the complementary female contact socket. Each of the receptacle and plug components is attached by a suitable termination means to respective electrical cables or wires (i.e., lines). In use, the receptacle component receives the plug component with the male pin penetrating and making an electrical connection with the female contact socket. Various designs exist in which there may be a single male pin engaging with a single contact module, or else a plurality of male pins and respective contact modules.

Electrical connectors may be used to prevent the electrical contacts from being exposed to sea water and other harmful matter, such as oil and drilling fluid for example. Maintaining a good seal around the electrical contacts may be necessary for long periods. Further, wellheads are frequently located at great depths, and wellhead connections are becoming more complex with increasing requirements for monitoring and control equipment. As such, the space available for connectors of the kind described above becomes reduced, and thus the need for more compact connectors increases.

BRIEF DESCRIPTION OF THE DRAWINGS

For a detailed description of the preferred embodiments of the present disclosure, reference will now be made to the accompanying drawings in which.

DETAILED DESCRIPTION

Figure 1:
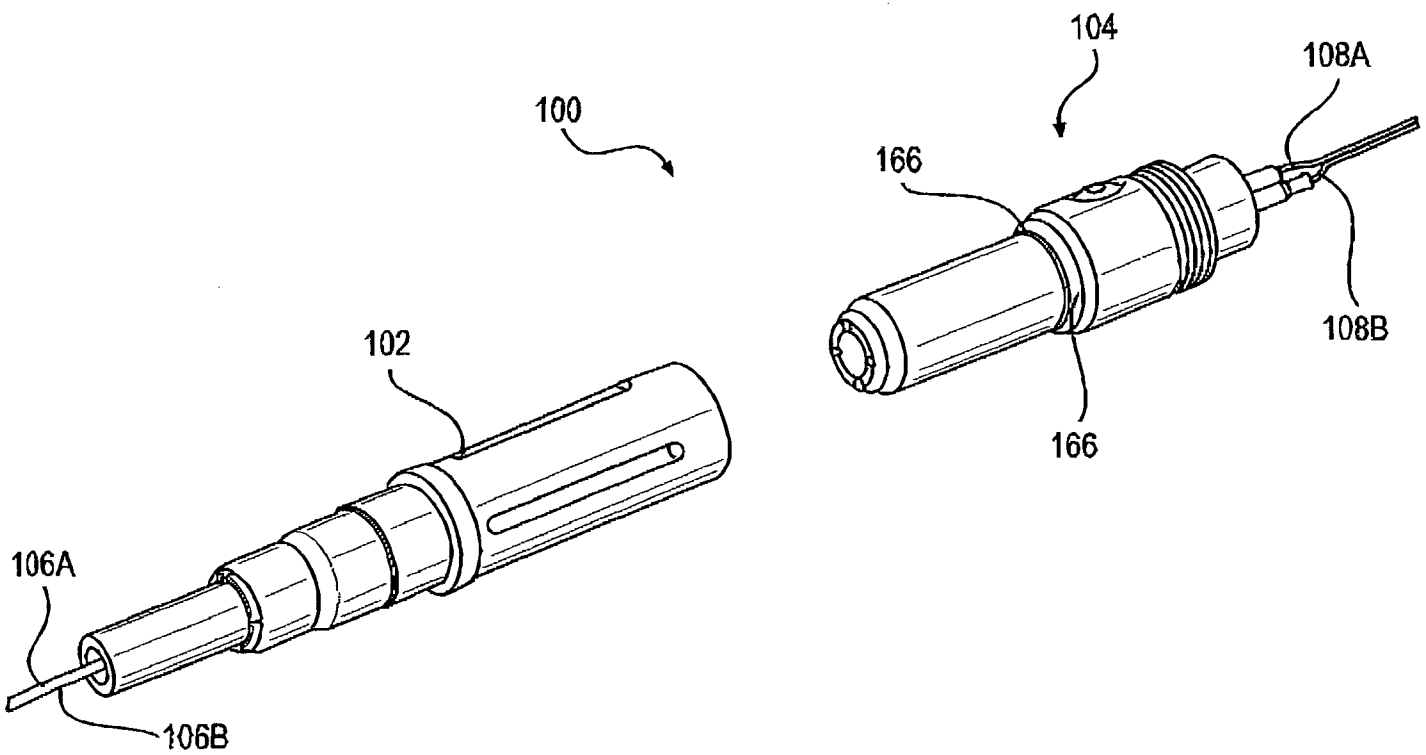
FIG. 1 shows a perspective view of a connector in accordance with one or more embodiments of the present disclosure.

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Referring now to FIG. 1, a perspective view of a connector 100 in accordance with one or more embodiments of the present disclosure is shown. The connector 100 may be an electrical connector, an optical connector, and/or any other type of connector known in the art. The connector 100 includes a receptacle component 102 (e.g., male component) and a plug component 104 (e.g., female component) before mating or connection with each other. As the connector 100 may be an electrical connector, the connector 100 may facilitate connection between one or more electrical lines. As such, in this embodiment, the connector 100 may facilitate connection between a first electrical line 106A and a second electrical line 106B of the receptacle component 102 with a first electrical line 108A and a second electrical line 108B of the plug component 104, respectively.

Figure 2A:
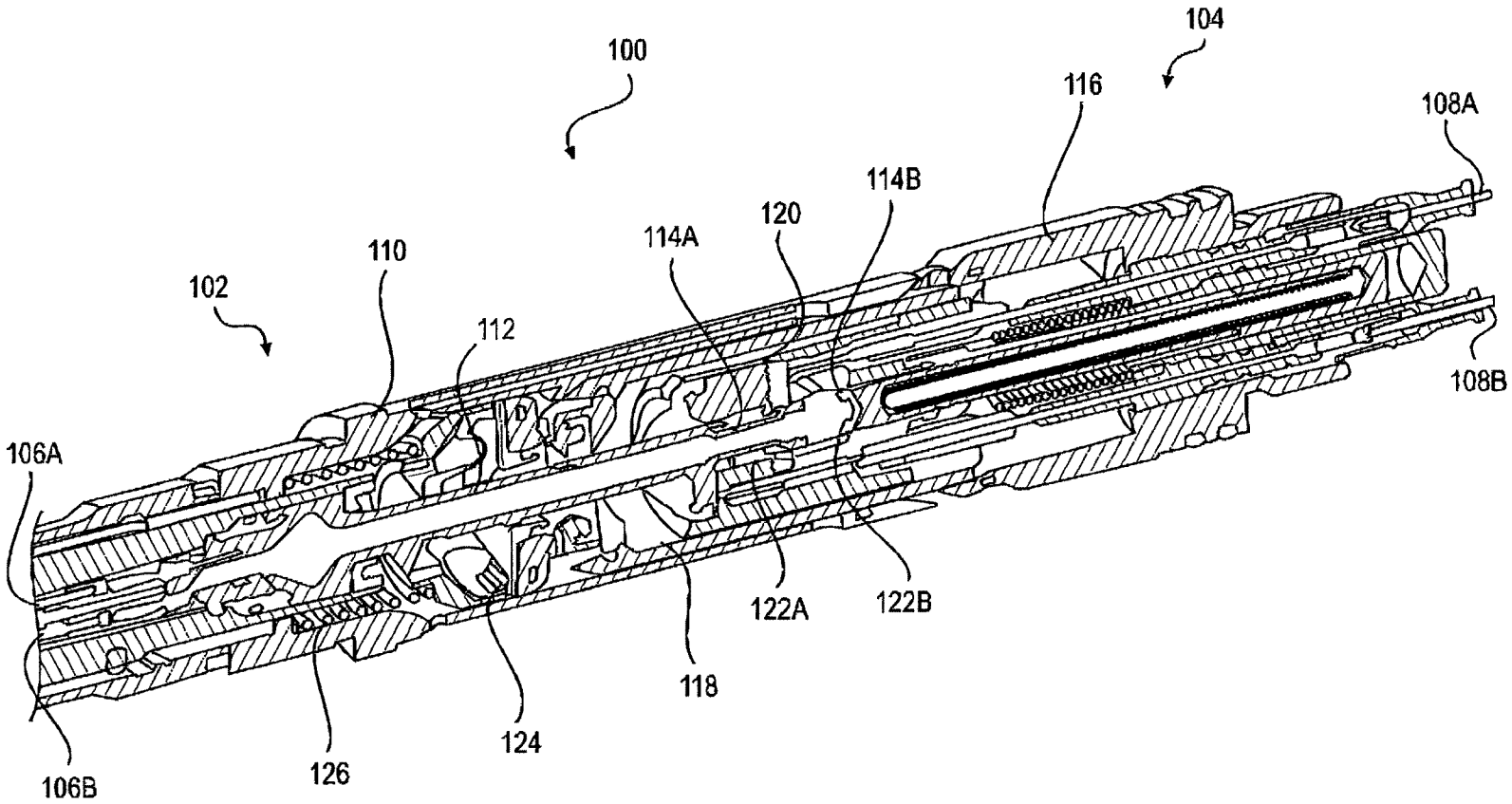
FIGS. 2A-2D show multiple views of a receptacle component and a plug component of a connector in accordance with one or more embodiments of the present disclosure.
Figure 2B:
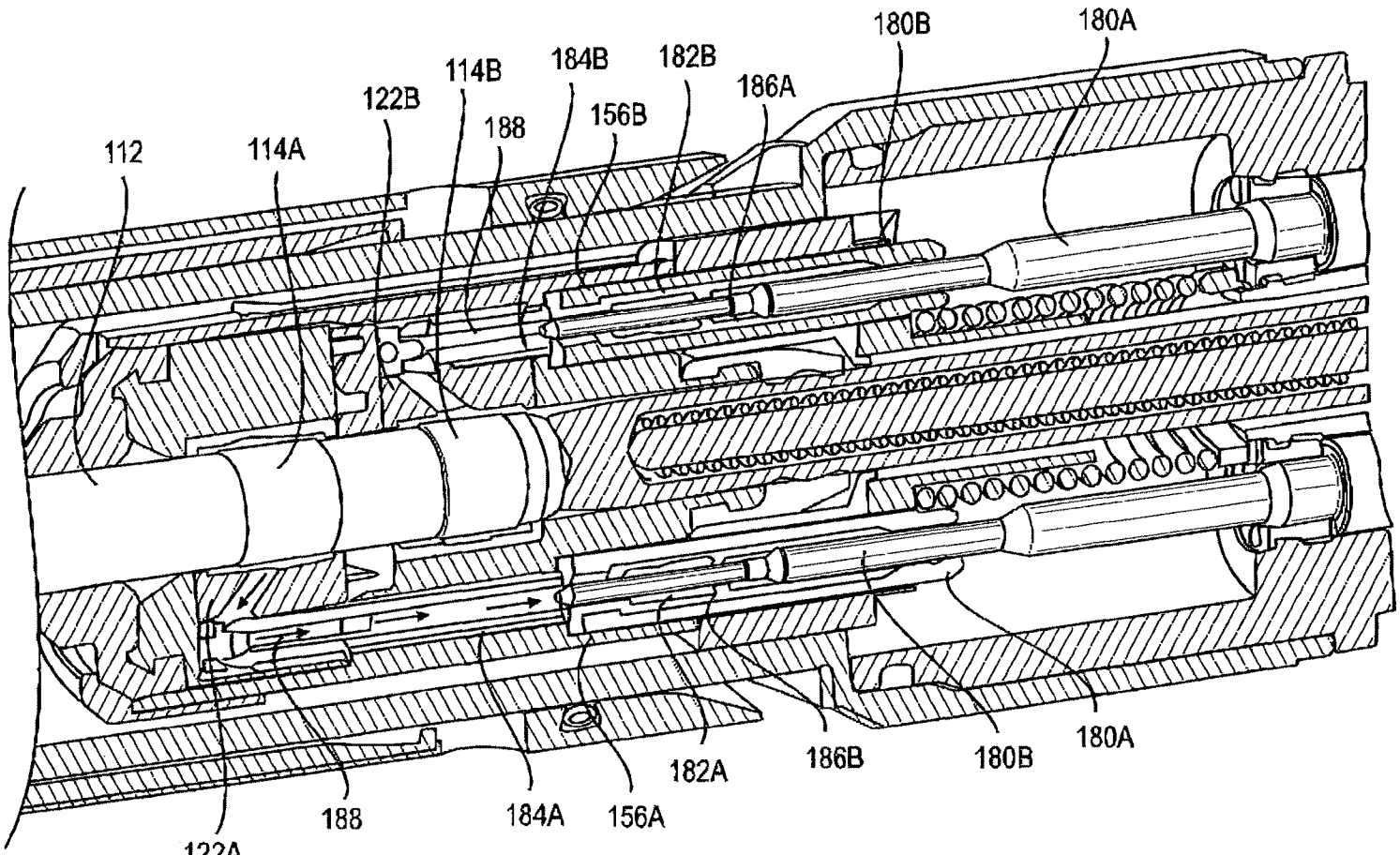
Figure 2C:
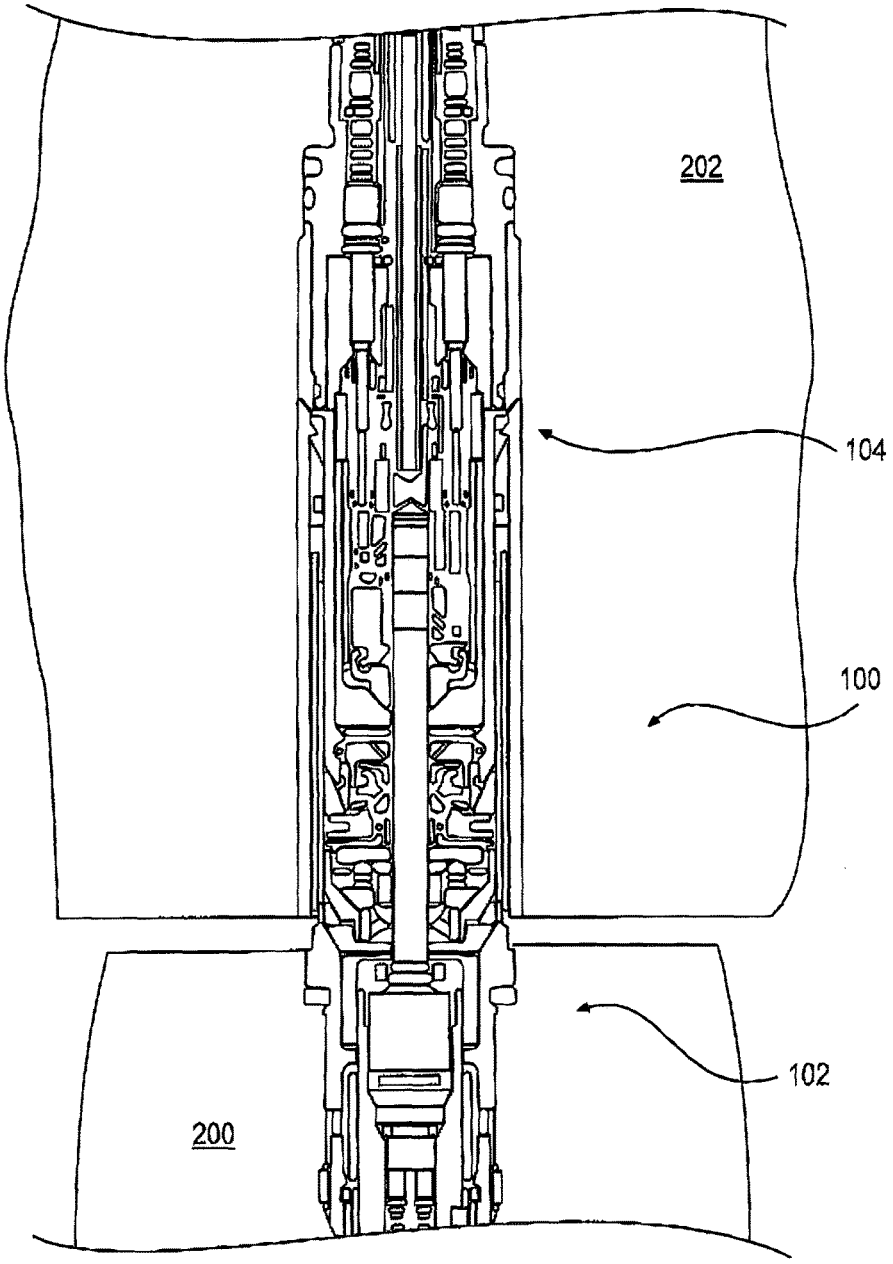

Referring now to FIGS. 2A, 2B, and 2C, multiple views of the receptacle component 102 and the plug component 104 of the connector 100 connected and/or mated with each other in accordance with one or more embodiments of the present disclosure are shown. Further, in FIG. 2D, a cross-sectional view of the receptacle component 102 in accordance with one or more embodiments of the present disclosure is shown. In particular, FIG. 2A shows a perspective cross-sectional view of the receptacle component 102 and the plug component 104 of the connector 100 connected and/or mated with each other, FIG. 2B shows a more detailed view of FIG. 2A, and FIG. 2C shows a cross-sectional view of the receptacle component 102 and the plug component 104 of the connector 100 connected and/or mated with each other. The connector 100 may be used to facilitate a connection within a subsea production tree, wellhead equipment, and/or between one or more other components. As such, as shown in FIG. 2C in particular, the connector 100 may be used to facilitate an electrical connection between or with a tubing hanger 200 and a tubing hanger running tool 202. In this embodiment, the receptacle component 102 may be received (e.g., threadably received) within or connected to the tubing hanger 200, and the plug component 104 may be received (e.g., threadably received) within or connected to the tubing hanger running tool 202.

The receptacle component 102 may include a receptacle housing 110 with a contact pin 112 included within the receptacle housing 110. The contact pin 112 may include one or more electrical contacts, such as a front contact band 114A (e.g., first contact band) and a rear contact band 114B (e.g., second contact band) (e.g., front and rear with respect to the plug component 104). Except for the locations of the front contact band 114A and the rear contact band 114B, the contact pin 112 may be insulated substantially along a length thereof with polyether ether ketone (PEEK) insulation material. Further, the front contact band 114A and/or the rear contact band 114B may include or be formed as two exposed contact surfaces that include an electrically conducting material, including a copper alloy, beryllium copper (BeCu), and/or a gold-plated chromium nickel alloy. In one or more embodiments, the front contact band 114A and the rear contact band 114B may be concentric to form a smooth continuous surface along the shaft of the contact pin 112, and also forming two separate and discrete electrical circuits. As such, the front contact band 114A may carry an electrical signal from and/or electrically connect with the first electrical line 106A, and the rear contact band 114B may carry an electrical signal from and/or electrically connect with the second electrical line 106B.

The plug component 104 may include a plug housing 116 with a bore 118 formed within the plug housing 116. The plug component 104 may further include a contact module 120, in which the contact module 120 may be slidably received (e.g., reciprocate) within the bore 118 of the plug housing 116. As such, the contact module 120 may include one or more electrical contacts, such as a front electrical contact 122A (e.g., first electrical contact) and a rear electrical contact 122B (e.g., second electrical contact). The contact module 120 and/or other components may include or be formed from substantially electrically insulating materials, such as high temperature thermoplastics, including PEEK, polyetherimide (PEI), polytetrafluoroethylene (PTFE), and/or other similar materials. The front electrical contact 122A may carry an electrical signal from and/or electrically connect with the second electrical line 108B, and the rear electrical contact 122B may carry an electrical signal from and/or electrically connect with the first electrical line 108A.

As such, when the connector 100 is connected as shown, one or more electrical connections may be formed between the receptacle component 102 and the plug component 104. In the embodiment shown in FIG. 2A, this may involve having the front contact band 114A of the contact pin 112 in contact with the front electrical contact 122A of the contact module 120, thereby forming one electrical connection therebetween. Further, this may involve having the rear contact band 114B of the contact pin 112 in contact with the rear electrical contact 122B of the contact module 120, thereby forming another electrical connection therebetween.

Figure 2D:
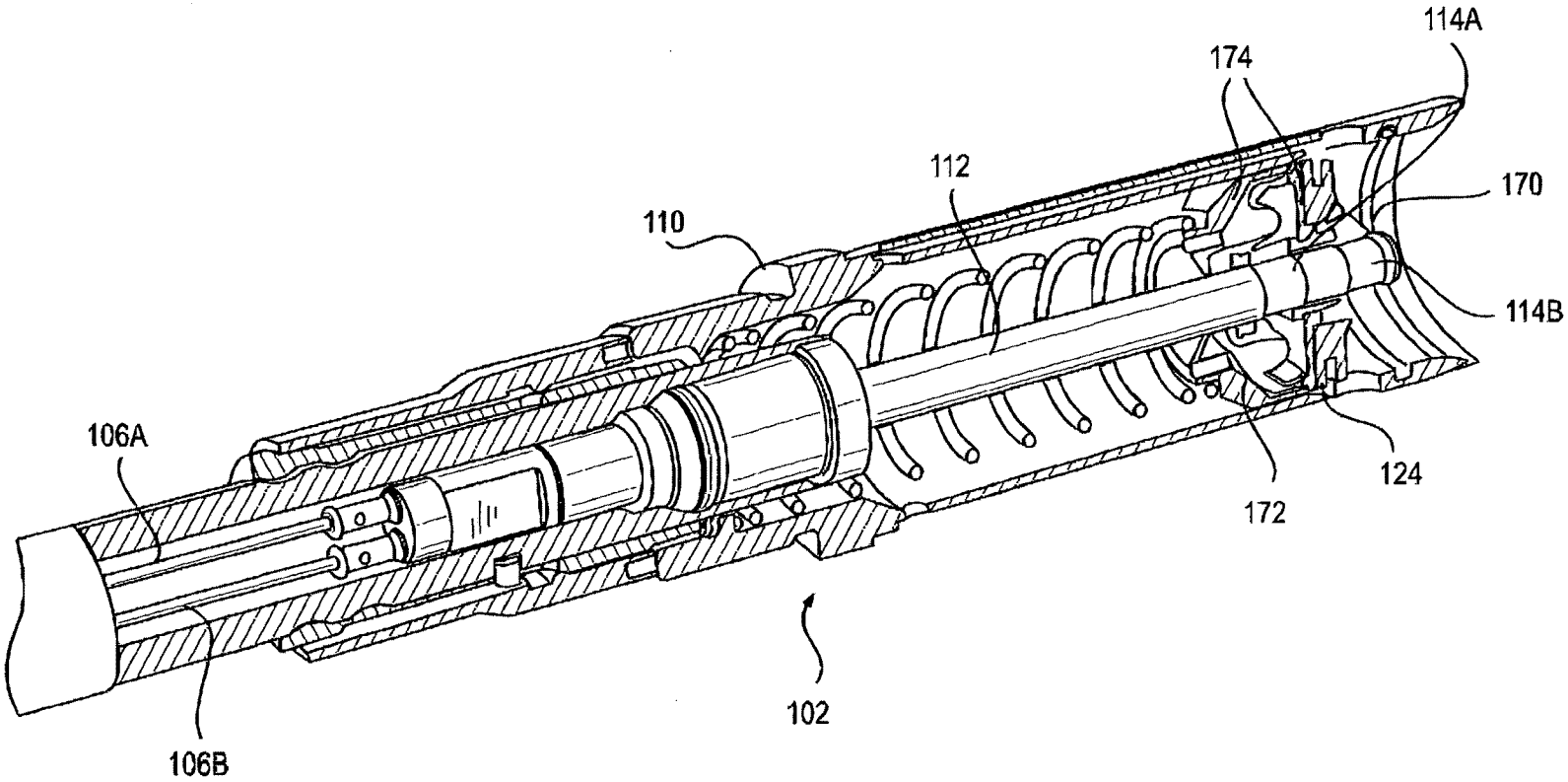

Referring still to FIGS. 2A and 2D, the receptacle component 102 may include a wiper assembly 124, such as slidably received within the receptacle housing 110. In particular, as shown in FIG. 2D, the wiper assembly 124 may include a wiper seal 170 and a wiper diaphragm seal 172, such as formed from elastomer, to substantially form an insulation chamber within the wiper assembly 124. The wiper assembly 124 may further include one or more support plates 174, such as including and/or formed from PEEK, to support the wiper seal 170 and/or the wiper diaphragm seal 172. The wiper assembly 124 may be used to wipe the contact pin 112. Additionally or alternatively, the wiper assembly 124 may be filled with dielectric fluid or electrically insulating grease to compensate for pressure, such as across the wiper seal 170 and/or the wiper diaphragm seal 172, and/or may lubricate to allow free movement of the wiper assembly 124 while undergoing the extreme environmental pressures when subsea. Furthermore, a wiper biasing mechanism 126, such as a spring as shown, may be included within the receptacle housing 110 to bias the wiper assembly 124 towards the mating end of the receptacle housing 110.

Figure 3:
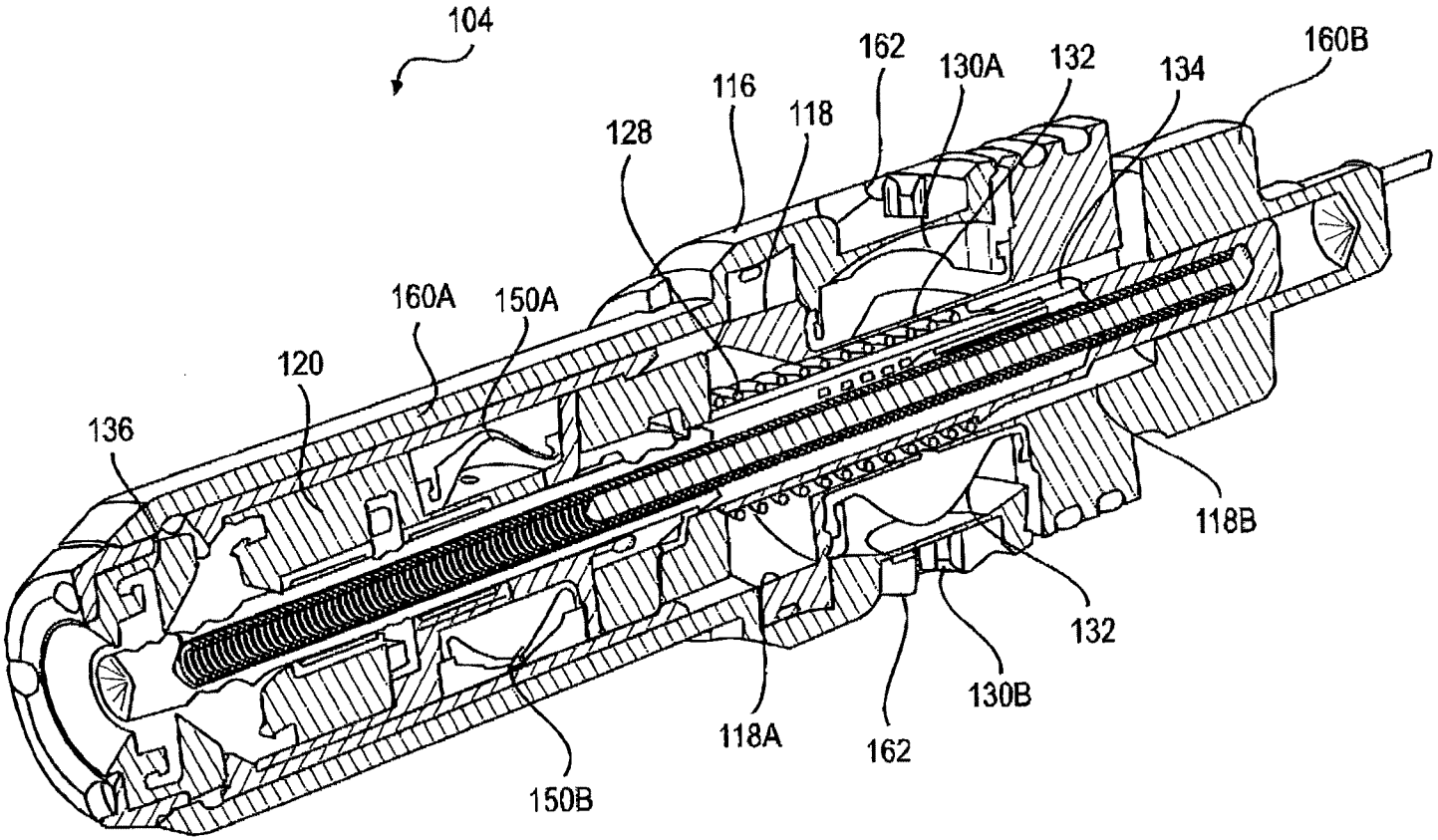
FIG. 3 shows a perspective cross-sectional view of a plug component in accordance with one or more embodiments of the present disclosure.

Referring now to FIG. 3, a perspective cross-sectional view of the plug component 104 in accordance with one or more embodiments of the present disclosure is shown. The cross-sectional view of the plug component 104 in FIG. 3 is along a cross-section that is different than that shown in FIG. 2A. The plug component 104 may include the plug housing 116 with the bore 118 formed within the plug housing 116, and may further include the contact module 120 slidably received within the bore 118 of the plug housing 116. As the contact module 120 may reciprocate within the plug housing 116, a contact module biasing mechanism 128, such as a spring, may be included within the plug housing 116 to bias the contact module 120 towards a mating end of the plug housing 116 and/or the plug component 104.

The plug component 104 may further include one or more diaphragms, such as to expand and contract in response to movement of the contact module 120 and/or to compensate for changes in pressure in response to movement of the contact module 120 with respect to other components. For example, a first plug component radial diaphragm 130A may be positioned within the plug housing 116, in which one side (e.g., an inner side towards the bore 118) of the first plug component radial diaphragm 130A may be in fluid communication with the bore 118 of the plug housing 116. The other side (e.g., an outer side away from the bore 118) of the first plug component radial diaphragm 130A may be vented external to the plug housing 116 to enable a pressure balance across the first plug component radial diaphragm 130A.

Further, a second plug component radial diaphragm 130B may be positioned within the plug housing 116, in which one side (e.g., an inner side towards the bore 118) of the second plug component radial diaphragm 130B may be in fluid communication with the bore 118 of the plug housing 116. The other side (e.g., an outer side away from the bore 118) of the second plug component radial diaphragm 130B may be vented external to the plug housing 116 to enable a pressure balance across the second plug component radial diaphragm 130B.

In this embodiment, one or more ports 132 may be formed between the plug component radial diaphragms 130A and 130B and the bore 118 of the plug housing 116 to enable fluid communication therebetween. Furthermore, as multiple plug component radial diaphragms may be included within this embodiment, the first plug component radial diaphragm 130A and the second plug component radial diaphragm 130B may be positioned radially about the bore 118 at substantially the same axial position with respect to the bore 118 of the plug housing 116.

As the first plug component radial diaphragm 130A may be in fluid communication with the bore 118 of the plug housing 116, a fluid chamber may be formed between the contact module 120 and the one side of the first plug component radial diaphragm 130A. Further, in an embodiment in which additional diaphragms may be included, the fluid chamber may extend to the one side of the second plug component radial diaphragm 130B in fluid communication with the bore 118 of the plug housing 116. In one or more embodiments, the fluid chamber may include a fluid, such as a dielectric oil, to provide electrical insulation and/or facilitate movement of the contact module 120 within the bore 118 of the plug housing 116.

Referring still to FIG. 3, the bore 118 of the plug housing 116, in addition or in alternative to other bores described herein, may vary in size and/or in shape. For example, a bore in accordance with the present disclosure may have a cross-sectional shape that is circular, but may also have cross-sectional shapes that are non-circular. Further, a bore may also have varying sizes, such as a larger size in some areas, and a smaller size in other areas. With reference to FIG. 3, the bore 118 of the plug housing 116 may include a larger bore 118A and a smaller bore 118B. The larger bore 118A may be formed towards the mating end of the plug housing 116, and the smaller bore 118B may be formed away from the mating end of the plug housing 116.

The contact module 120 may include a stem 134, such as extending away from the mating end of the plug housing 116. As shown, the contact module biasing mechanism 128 may be positioned about the stem 134 of the contact module 120. In such an embodiment, the stem 134 may then be slidably received within the smaller bore 118B of the plug housing 116, with the contact module 120 slidably received within the larger bore 118A of the plug housing 116. Furthermore, in one or more embodiments, a wiper seal 136 may be included within the plug housing 116, such as towards the mating end of the plug housing 116, such as to wipe the contact pin when entering through the mating end of the plug housing 116.

Figure 4A:
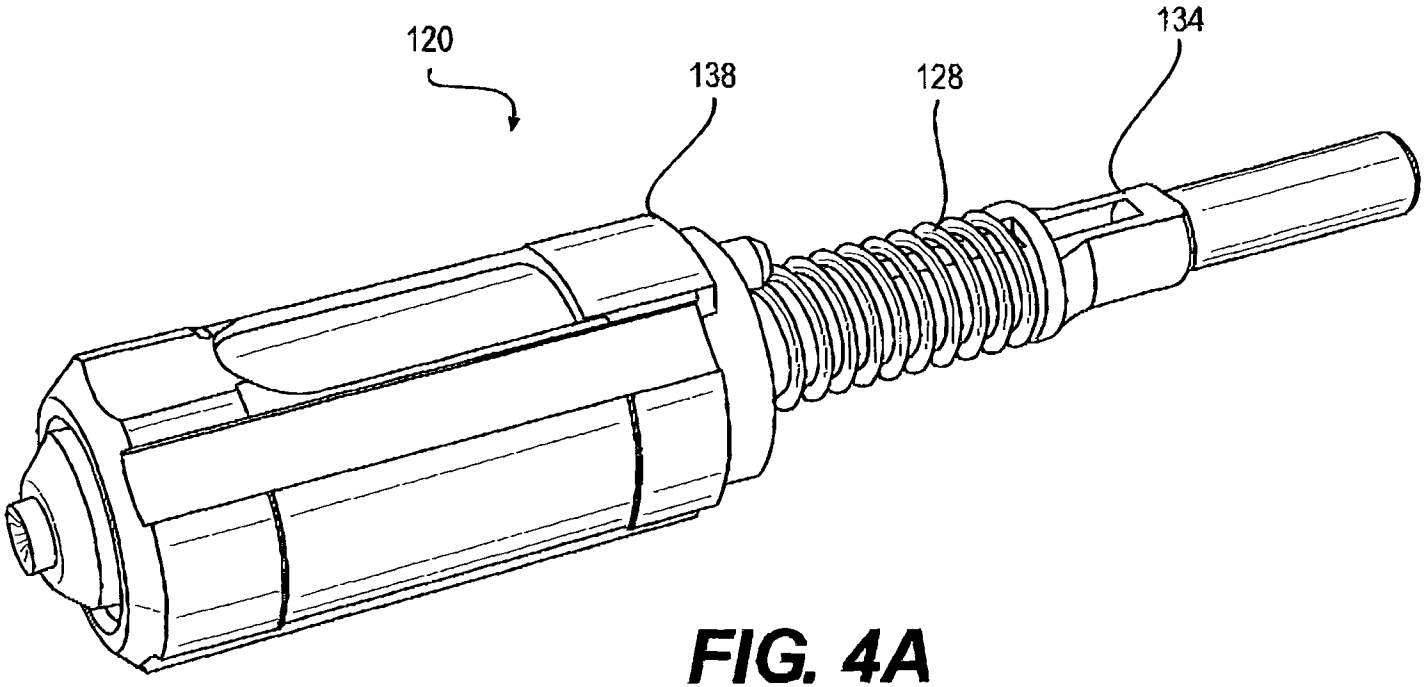
FIGS. 4A-4D show multiple perspective views of a contact module in accordance with one or more embodiments of the present disclosure.
Figure 4B:
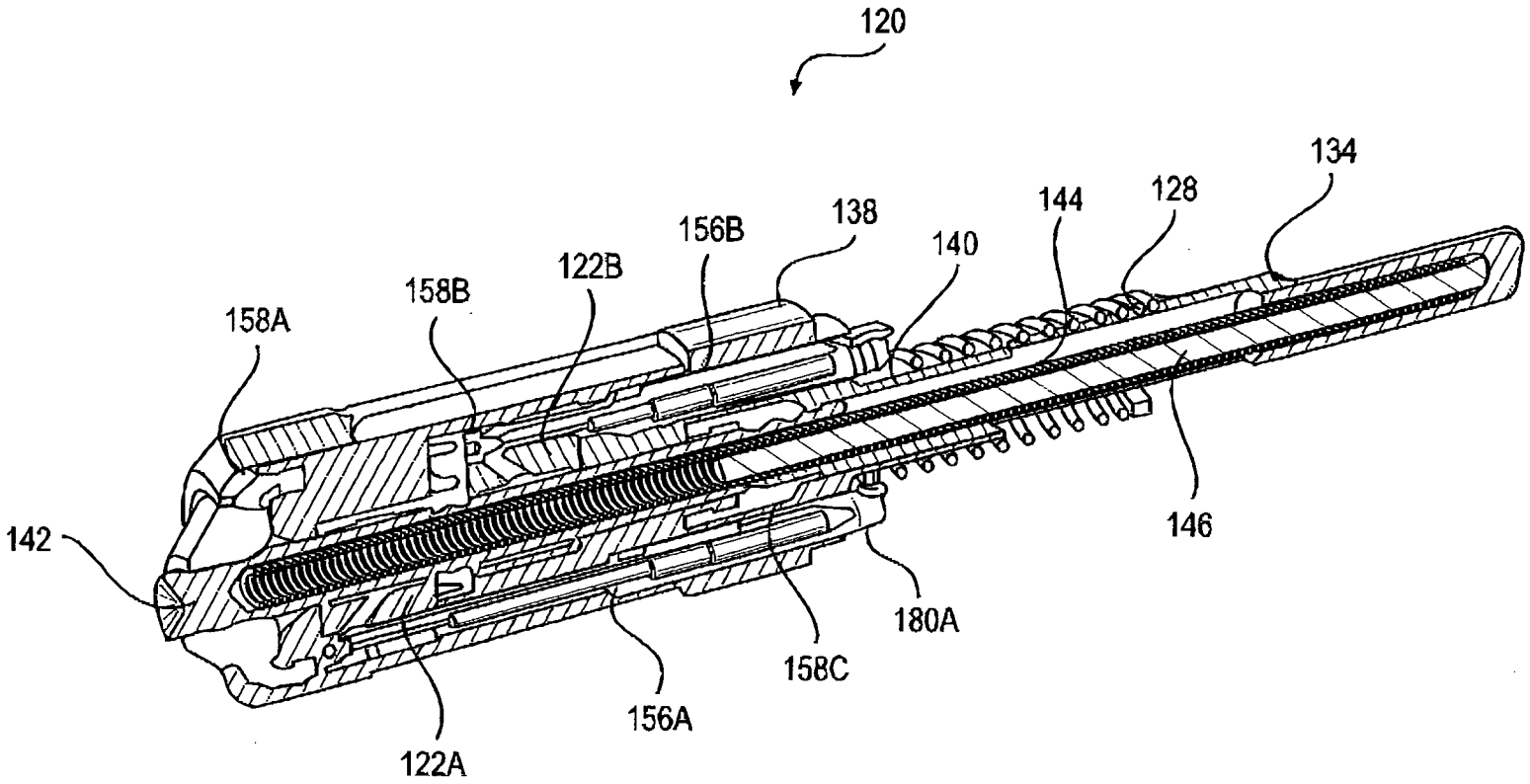
Figure 4C:
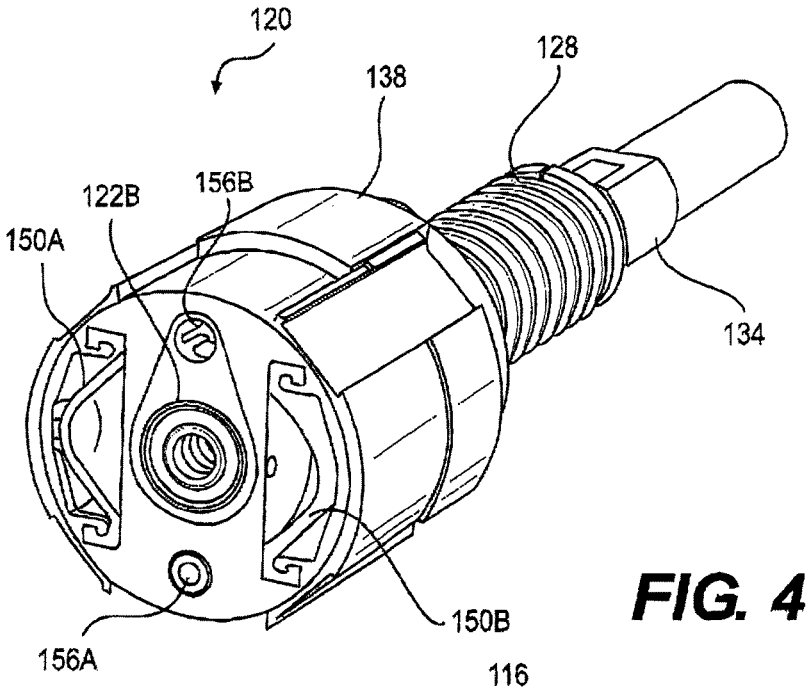
Figure 4D:
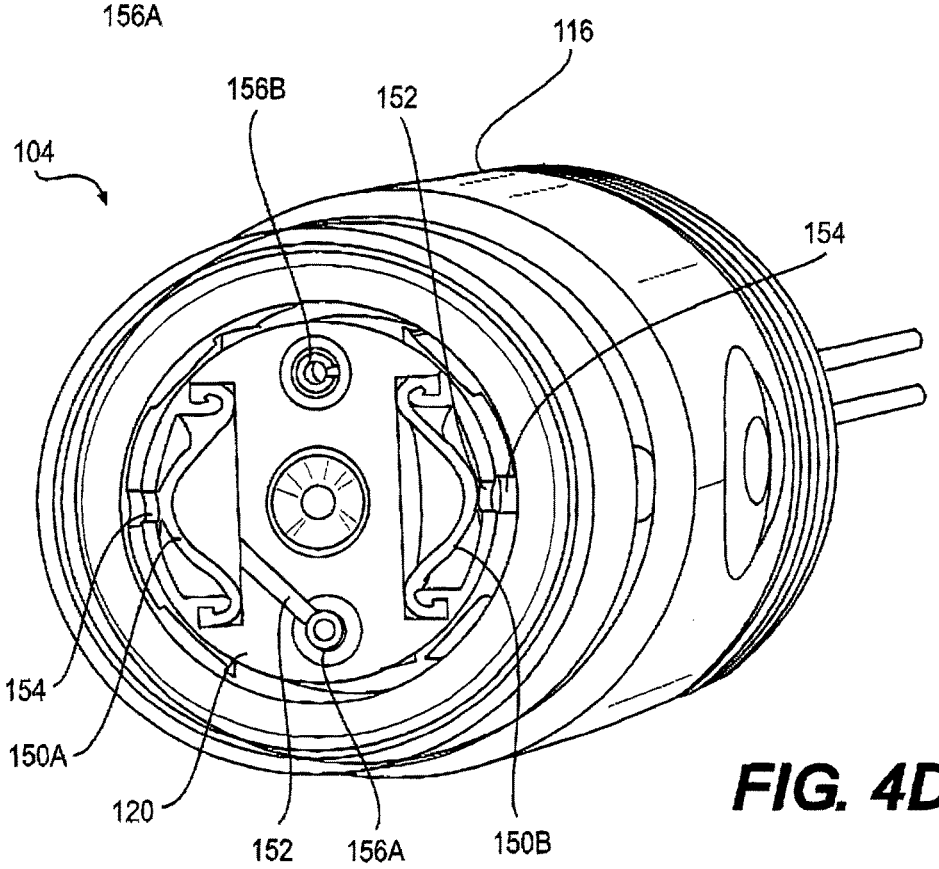

Referring now to FIGS. 4A-4D, multiple perspective views of the contact module 120 in accordance with one or more embodiments of the present disclosure are shown. In particular, FIG. 4A shows a perspective exterior view of the contact module 120, FIG. 4B shows a perspective cross-sectional view along the length of the contact module 120, FIG. 4C shows a perspective cross-sectional view across the contact module 120, and FIG. 4D shows another perspective cross-sectional view across the contact module 120 when positioned within plug housing 116 of the plug component 104. The cross-sectional view of the contact module 120 in FIG. 4B is similar to the cross-section shown in FIG. 2A, but is along a cross-section that is different than that shown in FIG. 3. Accordingly, these views may show different features that are described below.

The contact module 120 may include a contact module housing 138, in which a bore 140 may be formed within the contact module housing 138. A shuttle pin 142 may be slidably received within the bore 140 of the contact module housing 138. Further, a shuttle pin biasing mechanism 144, such as a spring, may be positioned within the contact module housing 138 to bias the shuttle pin 142 towards a mating end of the contact module housing 138. In this embodiment, a support pin 146 may be positioned within the bore 140 of the contact module housing 138, in which the shuttle pin biasing mechanism 144 may be positioned about the support pin 146. The support pin 146 may then be able to be slidably received within the shuttle pin 142, such as to facilitate movement of the shuttle pin 142 within the bore 140 of the contact module housing 138.

Further, in one or more embodiment, the contact module biasing mechanism 128 may be stronger (e.g., have a higher spring constant) than that of the shuttle pin biasing mechanism 144. As such, when a contact pin enters into the mating end of the contact module housing 138, the shuttle pin biasing mechanism 144 may compress and the shuttle pin 142 may move within the contact module 120 before the contact module biasing mechanism 128 compresses and the contact module 120 moves within the plug component 104.

As discussed above, the contact module 120 may include one or more electrical contacts, such as the front electrical contact 122A and the rear electrical contact 122B. The front electrical contact 122A may be positioned adjacent the bore 140 of the contact module housing 138, such as to facilitate connection with an electrical contact of a contact pin. Further, the rear electrical contact 122B may be positioned adjacent the bore 140 of the contact module housing 138, in which the front electrical contact 122A may be positioned axially along the bore 140 of the contact module housing 138 with respect to the rear electrical contact 122B.

In addition or in alternative to the plug component 104, the contact module 120 may include one or more diaphragms, such as to expand and contract and/or compensate for changes in pressure in response to movement of the shuttle pin 142 and/or the contact module 120. For example, a first contact module radial diaphragm 150A may be positioned within the contact module 120, in which one side (e.g., an inner side towards the bore 140) of the first contact module radial diaphragm 150A may be in fluid communication with the front electrical contact 122A. A second contact module radial diaphragm 150B may be positioned within the contact module 120, in which one side (e.g., an inner side towards the bore 140) of the second contact module radial diaphragm 150B may be in fluid communication with the rear electrical contact 122B. In particular, one or more channels 152 may be formed between the first contact module radial diaphragm 150A and the front electrical contact 122A to enable fluid communication therebetween, and one or more channels 152 may be formed between the second contact module radial diaphragm 150B and the rear electrical contact 122B to enable fluid communication therebetween.

Further, the other side (e.g., an outer side away from the bore 140) of the first contact module radial diaphragm 150A may be vented external to the contact module housing 138 to enable a pressure balance across the first contact module radial diaphragm 150A. Similarly, the other side (e.g., an outer side away from the bore 140) of the second contact module radial diaphragm 150B may be vented external to the contact module housing 138 to enable a pressure balance across the first contact module radial diaphragm 150A. In particular, one or more ports 154 may be formed between the first and second contact module radial diaphragms 150A and 150B and the exterior of the contact module housing 138 to enable fluid communication therebetween.

In one or more embodiments, as multiple contact module radial diaphragms may be included within this embodiment, the first contact module radial diaphragm 150A and the second contact module radial diaphragm 150B may be positioned radially about the bore 140 at substantially the same axial position with respect to the bore 140 of the contact module housing 138. Furthermore, in one or more embodiments, an electrical contact and a contact module radial diaphragm may overlap, at least partially, in axial position with respect to the bore of the contact module. For example, as shown in FIGS. 4C and 4D, the rear electrical contact 122B and the second contact module radial diaphragm 150B may overlap, at least partially, in axial position with respect to the bore 140 of the contact module housing 138.

As the first contact module radial diaphragm 150A may be in fluid communication with the front electrical contact 122A, a fluid chamber may be formed between the front electrical contact 122A and the one side of the first contact module radial diaphragm 150A in fluid communication with the front electrical contact 122A. Similarly, as the second contact module radial diaphragm 150B may be in fluid communication with the rear electrical contact 122B, another fluid chamber may be formed between the rear electrical contact 122B and the one side of the second contact module radial diaphragm 150B in fluid communication with the rear electrical contact 122B. In one or more embodiments, one or both of the fluid chambers may include a fluid, such as a dielectric oil, to facilitate movement of the shuttle pin 142 and/or the contact module 120.

Referring still to FIGS. 4A-4D, the contact module 120 may include one or more electrical contact sockets, in which the electrical contact socket may be used to receive an electrical line. In particular, an electrical contact socket may be included for each electrical line received by the plug component 104 and/or each electrical contact included within the contact module 120. For example, the contact module 120 may include a first electrical contact socket 156A that receives an electrical line, such as the second electrical line 108B. Further, the contact module 120 may include a second electrical contact socket 156B that receives an electrical line, such as the first electrical line 108A. An electrical line in accordance with the present disclosure may refer to a wire, cable, and/or any other features or components that may be capable of carrying an electrical signal and/or enabling electrical communication. As such, an electrical line in accordance with the present disclosure may be formed from one or more components connected to each other to enable a signal to be communicated through the electrical line.

With reference to FIGS. 4B and 2B, the first electrical contact socket 156A may include a lip seal 180A, a socket contact 182A, and/or a socket channel 184A extending from the socket contact 182A to the front electrical contact 122A. The first electrical contact socket 156A may slidingly receive a contact pin 186B of the second electrical line 108B through the lip seal 180A and into the first electrical contact socket 156A to establish an electrical connection between the contact pin 186B and the socket contact 182A. This engagement may also establish an electrical connection between the contact pin 186B and the front contact band 114A of the contact pin 112 through the socket channel 184A and the front electrical contact 122A. Dielectric oil 188 may also be present within the first electrical contact socket 156A, such as to provide electrical insulation and/or facilitate movement of the contact pin 186B with respect to the first electrical contact socket 156A. Further, the second electrical contact socket 156B may include a lip seal 180B, a socket contact 182B, and/or a socket channel 184B extending from the socket contact 182B to the rear electrical contact 122B. The second electrical contact socket 156B may slidingly receive a contact pin 186A of the first electrical line 108A through the lip seal 180B and into the second electrical contact socket 156B to establish an electrical connection between the contact pin 186A and the socket contact 182B. This engagement may also establish an electrical connection between the contact pin 186A and the rear contact band 114B of the contact pin 112 through the socket channel 184B and the rear electrical contact 122B. Dielectric oil 188 may also be present within the first electrical contact socket 156A and/or the second electrical contact socket 156B, such as to provide electrical insulation and/or facilitate movement of the contact pins 186A and 186B with respect to the electrical contact sockets 156A and 156B. As such, as the contact module 120 may reciprocate and move within the plug housing 116 of the plug component 104, the contact pins 186A and 186B of the electrical lines 108A and 108B may correspondingly move and reciprocate within the electrical contact sockets 156A and 156B while still maintaining electrical connections therebetween.

In one or more embodiments, the electrical lines 108A and 108B may include an insulating material, such as PEEK, to electrically insulate an outer surface thereof. Further, the contact pins 186A and 186B, the socket contacts 182A and 182B, and/or the socket channels 184A and 184B may be formed or include an electrically conducting material, including a copper alloy, beryllium copper, and/or a gold-plated chromium nickel alloy. Furthermore, the lip seals 180A and 180B, and/or any other seals and/or diaphragms within the present disclosure, may include or be formed of an elastomer, which may include a synthetic rubber, fluoropolymer elastomer (such as provided by Viton), and/or hydrogenated nitrile butadiene rubber (HBNR). As such, one or more seals and/or diaphragms may be used within the present disclosure to electrically insulate about and/or around electrical contacts and connections within the connector 100.

As shown particularly in FIG. 4C, an electrical contact may have a lobed cross-sectional shape, such as to minimize the footprint of the electrical contact within the contact module. For example, the rear electrical contact 122B is shown in FIG. 4C having a lobed cross-sectional shape, in which the rear electrical contact 122B may extend between the bore 140 of the contact module housing 138 and the second electrical contact socket 156B. Additionally or alternatively, the cross-sectional shape of the rear electrical contact 122B may be wider at the bore 140 than at the second electrical contact socket 156B. The front electrical contact 122A may have a similar configuration, such as to extend between the bore 140 of the contact module housing 138 and the first electrical contact socket 156A.

In one or more embodiments, as the contact module 120 moves within the plug housing 116 of the plug component 104, the component of the electrical line(s) received within the electrical contact socket(s) may also correspondingly move. As such, to facilitate this movement, the contact module radial diaphragm(s) may be in fluid communication with the electrical contact socket(s). For example, the one side (e.g., an inner side towards the bore 140) of the first contact module radial diaphragm 150A may be in fluid communication with the first electrical contact socket 156A. Further, the one side (e.g., an inner side towards the bore 140) of the second contact module radial diaphragm 150B may be in fluid communication with the fluid electrical contact socket 156B.

In one or more embodiments, the contact module 120 may include one or more seals. For example, as shown in FIG. 4B, the contact module 120 may include a front lip seal 158A in front of the front electrical contact 122A and towards the mating end of the contact module housing 138. The contact module 120 may additionally or alternatively include an intermediate lip seal 158B between the front electrical contact 122A and the rear electrical contact 122B, and/or may include a rear lip seal 158C behind the rear electrical contact 122B and away from the mating end of the contact module housing 138.

Figure 5A:
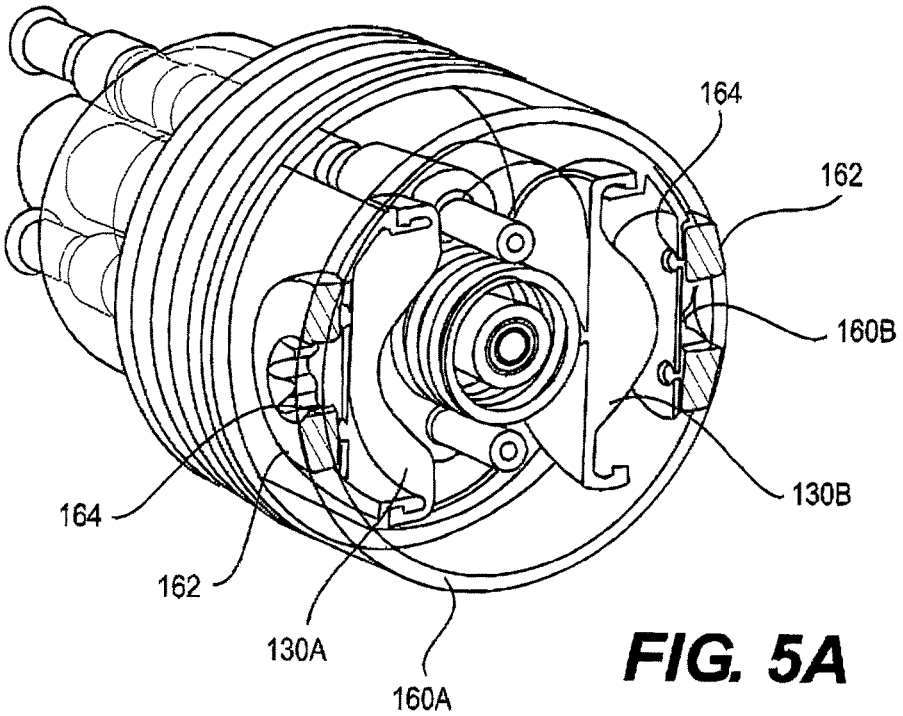
FIGS. 5A and 5B show multiple perspective views of retaining rings in accordance with one or more embodiments of the present disclosure.
Figure 5B:
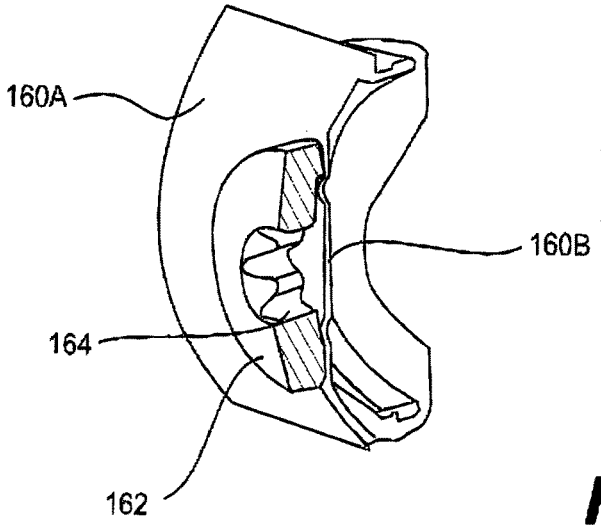

In one or more embodiments, a housing, and/or any other component for that matter, may be formed from two or more sections and/or two or more pieces connected and/or attached to each other. For example, as shown in FIG. 3, the plug housing 116 of the plug component 104 may include a front section 160A (e.g., a first section) and a rear section 160B (e.g., a second section). Such an configuration may facilitate assembling the plug housing 116. Further, one or more retaining rings 162 may be used to retain the connection and/or arrangement of the front and rear sections 160A and 160B with each other. In particular, as shown in FIG. 3, and also in FIGS. 5A and 5B, the retaining rings 162 may be positioned between the front section 160A and the rear section 160B to retain the sections 160A and 160B to each other. Furthermore, one or more ports 164 may be formed within the exterior of the of the plug housing 116, such as within the rear section 160B and/or adjacent the retaining rings 162, to enable the other side (e.g., an outer side away from the bore 118) of the first and/or second plug component radial diaphragms 130A and 130B to be vented external to the plug housing 116.

In one or more embodiments, a connector in accordance of the present disclosure may be similar to the connector discussed and disclosed within U.S. Pat. No. 7,112,080, both of which are incorporated herein by reference in their entirety for all purposes as well as attached to this application. Each of the components of the connector may be sealingly positioned and/or engaged with respective wellhead equipment to be connected to each other such that the receptacle component and the plug component may mate with each other. The sealing interface and geometry for the connector may be established, such as through the use of elastomeric seals and/or metal seals.

The electrical contacts may each be sealed in individual pressure balanced oil filled chamber. Further, each electrical contact may be fed with insulating dielectric oil by a pressure compensating radial diaphragm situated in the contact module that is communicated to the electrical contact region through one or more channels, as shown and discussed above. The radial diaphragms may minimize the length of the contact module.

During engagement, the contact pin of the receptacle component may engage and push the shuttle pin within the contact module until the shuttle pin abuts against the support pin. This sets the position of the male and female electrical contacts of the receptacle component of the plug component relative to each other to form an electrical connection. Further, the contact module biasing mechanism, which may have a higher spring constant than the shuttle pin biasing mechanism, may bias the contact module towards the receptacle component when engaged. This may enable the connector to accommodate a connection range between the receptacle component and the plug component, such as between a range from about 0 inches to about 0.500 inches. Further, installation may require one or more of the components of the connector to be screwed into an interface profile, such as under considerable torque. As such, one or more drive slots 166 may be provided, such as shown in FIG. 1, on an exterior of the plug component 104 to receive an installation tool with male keys or teeth or a male spline to torque the plug component 104.

Whereas many alterations and modifications of the present invention will no doubt become apparent to a person of ordinary skill in the art after having read the foregoing description, it is to be understood that the particular embodiments shown and described by way of illustration are in no way intended to be considered limiting.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A contact module for a component of an electrical connector, comprising:

a housing including a bore formed within the housing and a mating end;

a shuttle pin slidably received within the bore of the housing;

a biasing mechanism to bias the shuttle pin towards the mating end of the housing;

an electrical contact positioned adjacent the bore of the housing; and a diaphragm positioned within the housing and radially expandable with respect to the bore, wherein the diaphragm comprises an inner side toward the bore and an outer side away from the bore, wherein the outer side is vented external to the housing, and the electrical contact is in fluid communication with the inner side of the diaphragm through a fluid channel such that the diaphragm allows the electrical contact to displace a fluid from an electrical contact socket to the inner side of the diaphragm.

2. The contact module of claim 1, further comprising:

a second electrical contact positioned adjacent the bore of the housing and axially along the bore with respect to the first electrical contact; and a second diaphragm positioned within the housing with a second fluid channel formed between one side of the second diaphragm and the second electrical contact.

3. The contact module of claim 2, wherein the first diaphragm and the second diaphragm are positioned radially about the bore at substantially the same axial position with respect to the bore.

4. The contact module of claim 1, wherein the electrical contact and the diaphragm overlap, at least partially, in axial position with respect to the bore.

5. The contact module of claim 1, further comprising an electrical contact socket configured to receive an electrical line, wherein the electrical contact extends between the bore and the electrical contact socket such that the electrical contact is in electrical communication with the electrical line, and wherein a cross-sectional shape of the electrical contact is wider at the bore than at the electrical contact socket.

6. The contact module of claim 1, wherein:

the fluid comprises a dielectric medium.

7. The contact module of claim 1, wherein the component of the electrical connector comprises a plug component, and wherein the electrical contact is configured to form an electrical connection with a contact pin of a receptacle component of the electrical connector.

8. The contact module of claim 7, further comprising a support pin positioned within the bore of the housing, wherein:

the contact pin is configured to engage and move the shuttle pin within the bore of the housing until the shuttle pin abuts the support pin;

the plug component comprises a plug housing with a bore formed within the plug housing;

the contact module is slidably received within the bore of the plug housing; and a second biasing mechanism is configured to bias the contact module towards a mating end of the plug housing.

9. The contact module of claim 8, wherein:

the bore of the plug housing comprises a larger bore formed towards the mating end of the plug housing and a smaller bore formed away from the mating end of the plug housing;

the contact module comprises a stem with the second biasing mechanism positioned about the stem; and the stem is slidably received within the smaller bore of the plug housing.

10. The contact module of claim 8, further comprising a second diaphragm positioned within the plug housing of the plug component with one side of the second diaphragm in fluid communication with the bore of the plug housing to compensate for changes in pressure within the bore of the plug housing and with the other side of the second diaphragm vented external to the plug housing.

11. The contact module of claim 8, wherein the plug housing comprises a first section and a second section, wherein a retaining ring is positioned between the first section and the second section to retain the first section and the second section to each other, and wherein the plug housing comprises a drive slot on an exterior surface thereof.

12. A plug component of an electrical connector, comprising:

a plug housing including a bore formed within the plug housing;

a contact module comprising an electrical contact, the contact module slidably received within the bore of the plug housing;

a contact module biasing mechanism to bias the contact module towards a mating end of the plug housing; and a plug component diaphragm positioned within the plug housing and radially about the bore of the plug housing, wherein the plug component diaphragm comprises an inner side toward the bore, and an outer side away from the bore, wherein the inner side of the plug component diaphragm is in fluid communication with the bore of the plug housing, and the outer side of the plug component diaphragm is vented external to the plug housing.

13. The plug component of claim 12, wherein the contact module further comprises:

a contact module housing including a bore formed within the contact module housing;

a shuttle pin slidably received within the bore of the contact module housing;

a shuttle pin biasing mechanism to bias the shuttle pin towards a mating end of the contact module housing;

the electrical contact positioned adjacent the bore of the contact module housing; and a contact module diaphragm positioned within the contact module housing with a fluid channel formed between one side of the contact module diaphragm and the electrical contact.

14. The plug component of claim 13, the contact module further comprising:

a second electrical contact positioned adjacent the bore of the contact module housing and axially along the bore with respect to the first electrical contact; and a second contact module diaphragm positioned within the contact module housing with a second channel formed between one side of the second contact module diaphragm and the second electrical contact;

wherein the first contact module diaphragm and the second contact module diaphragm are positioned radially about the bore at substantially the same axial position with respect to the bore.

15. The plug component of claim 13, wherein the contact module further comprises:

an electrical contact socket configured to receive an electrical line;

wherein the electrical contact extends between the bore of the contact module housing and the electrical contact socket such that the electrical contact is in electrical communication with the electrical line;

wherein a cross-sectional shape of the electrical contact is wider at the bore than at the electrical contact socket; and wherein the one side of the contact module diaphragm is in fluid communication with the electrical contact socket.

16. The plug component of claim 12, wherein:

the bore of the plug housing comprises a larger bore formed towards the mating end of the plug housing and a smaller bore formed away from the mating end of the plug housing;

the contact module further comprises a stem with the contact module biasing mechanism positioned about the stem; and the stem is slidably received within the smaller bore of the plug housing.

17. The plug component of claim 12, wherein a fluid that is in fluid communication with the inner side and the bore comprises a dielectric medium.

18. The plug component of claim 12, further comprising:

a second plug component diaphragm positioned within the plug housing with one side of the second plug component diaphragm in fluid communication with the bore of the plug housing to compensate for changes in pressure within the bore of the plug housing; and wherein the first plug component diaphragm and the second plug component diaphragm are positioned radially about the bore at substantially the same axial position with respect to the bore.

19. A method of forming an electrical connection, comprising:

receiving a contact pin of a receptacle component of an electrical connector within a contact module of a plug component of the electrical connector, thereby radially expanding, with a fluid, a contact module diaphragm with respect to a bore of the contact module, to compensate for a change in pressure of the fluid as the contact pin is received within the contact module, wherein the contact module diaphragm comprises an inner side toward a bore, and an outer side away from the bore, wherein the outer side is vented external to the housing;

electrically connecting the contact pin with an electrical contact of the contact module.

20. The method of claim 19, the method further comprising:

displacing the contact module within the plug component, thereby radially expanding a plug component diaphragm of the plug component to compensate for a change in pressure as the contact module is displaced within the plug component and venting pressure external to the plug component with the plug component diaphragm.

* * * * *